US011111739B2

(12) United States Patent
Smith et al.

(10) Patent No.: US 11,111,739 B2
(45) Date of Patent: Sep. 7, 2021

(54) WELL BORE CONDITIONER AND STABILIZER

(71) Applicant: Extreme Technologies, LLC, Vernal, UT (US)

(72) Inventors: Joshua J. Smith, Vernal, UT (US); Joseph Aschenbrenner, Blackfoot, ID (US); Gilbert Troy Meier, Vernal, UT (US)

(73) Assignee: EXTREME TECHNOLOGIES, LLC, Vernal, UT (US)

( * ) Notice: Subject to any disclaimer, the term of this patent is extended or adjusted under 35 U.S.C. 154(b) by 0 days.

(21) Appl. No.: 16/126,394

(22) Filed: Sep. 10, 2018

(65) Prior Publication Data

US 2019/0078399 A1 Mar. 14, 2019

Related U.S. Application Data

(60) Provisional application No. 62/556,379, filed on Sep. 9, 2017, provisional application No. 62/649,666, filed on Mar. 29, 2018.

(51) Int. Cl.
*E21B 10/30* (2006.01)
*E21B 17/10* (2006.01)

(52) U.S. Cl.
CPC ..... *E21B 17/1078* (2013.01)

(58) Field of Classification Search
CPC ..... E21B 17/1078; E21B 10/30; E21B 10/265
See application file for complete search history.

(56) References Cited

U.S. PATENT DOCUMENTS

| | | | |
|---|---|---|---|
| 1,489,849 | A | 4/1924 | Sidney et al. |
| 1,772,491 | A | 8/1930 | Koppl |
| 3,231,033 | A | 1/1966 | Williams |
| 3,237,705 | A | 3/1966 | Williams |
| 3,391,749 | A | 7/1968 | Arnold |
| 3,561,549 | A | 2/1971 | Garrison |
| 3,575,247 | A | 4/1971 | Feenstra |
| 3,851,719 | A | 12/1974 | Thompson |
| 3,916,998 | A | 11/1975 | Bass |

(Continued)

FOREIGN PATENT DOCUMENTS

| | | |
|---|---|---|
| EP | 219959 A1 | 4/1987 |
| EP | 1039095 A1 | 9/2000 |

(Continued)

OTHER PUBLICATIONS

PCT Search Report and Written Opinion for PCT App. No. PCT/US18/050208, dated Nov. 8, 2018.

(Continued)

*Primary Examiner* — Catherine Loikith
(74) *Attorney, Agent, or Firm* — Patent Law Works, LLP; Craig Buschmann

(57) ABSTRACT

A drill string stabilizer for use in a well bore includes a tubular body with a stabilizer axis, a first roller including a first roller axis spaced apart from the stabilizer axis of the tubular body, and at least a second roller spaced longitudinally apart from the first roller, the at least a second roller including a second roller axis spaced apart from the stabilizer axis of the tubular body. The first roller is angularly offset from the at least the second roller around a circumference of the tubular body.

15 Claims, 4 Drawing Sheets

(56) References Cited

U.S. PATENT DOCUMENTS

| | | | | |
|---|---|---|---|---|
| 3,982,594 | A * | 9/1976 | Berthiaume | E21B 10/18 175/337 |
| 4,080,010 | A | 3/1978 | Young | |
| 4,156,374 | A | 5/1979 | Shwayder | |
| 4,610,307 | A | 9/1986 | Jurgens | |
| 4,729,438 | A | 3/1988 | Walker | |
| 4,807,708 | A | 2/1989 | Forrest | |
| 4,989,681 | A | 2/1991 | Lohmuller | |
| 5,186,265 | A | 2/1993 | Henson | |
| 5,372,351 | A | 10/1994 | Oliver | |
| 5,495,899 | A | 3/1996 | Pastusek | |
| 5,497,842 | A | 3/1996 | Pastusek | |
| 5,667,027 | A | 9/1997 | Poffenroth | |
| 5,735,359 | A | 4/1998 | Lee | |
| 5,765,653 | A | 6/1998 | Doster | |
| 5,957,223 | A | 9/1999 | Doster | |
| 5,992,548 | A | 11/1999 | Silva | |
| 6,039,130 | A | 3/2000 | Pruet | |
| RE36,817 | E | 8/2000 | Pastusek | |
| 6,109,374 | A | 8/2000 | Burca et al. | |
| 6,116,356 | A | 9/2000 | Doster | |
| 6,213,226 | B1 | 4/2001 | Eppink et al. | |
| 6,227,312 | B1 | 5/2001 | Eppink et al. | |
| 6,257,279 | B1 | 7/2001 | Peltz | |
| 6,386,302 | B1 | 5/2002 | Beaton | |
| 6,397,958 | B1 | 6/2002 | Charles | |
| 6,488,104 | B1 | 12/2002 | Eppink | |
| 6,494,272 | B1 | 12/2002 | Eppink | |
| 6,607,371 | B1 | 8/2003 | Raymond et al. | |
| 6,609,580 | B2 | 8/2003 | Beaton | |
| 6,622,803 | B2 | 9/2003 | Harvey | |
| 6,695,080 | B2 | 2/2004 | Presley | |
| 6,732,817 | B2 | 5/2004 | Dewey | |
| 6,920,944 | B2 | 7/2005 | Eppink | |
| 6,973,974 | B2 | 12/2005 | McLoughlin | |
| 6,991,046 | B2 | 1/2006 | Fielder | |
| 7,650,952 | B2 | 1/2010 | Evans | |
| 7,901,137 | B1 | 3/2011 | Peterson | |
| 8,752,649 | B2 | 6/2014 | Isenhour | |
| 8,813,877 | B1 | 8/2014 | Short | |
| 8,851,205 | B1 | 10/2014 | Short | |
| 9,145,746 | B1 | 9/2015 | Smith | |
| 9,163,460 | B2 | 10/2015 | Isenhour | |
| 9,273,519 | B2 | 3/2016 | Smith | |
| 9,739,092 | B2 | 8/2017 | Isenhour | |
| 2001/0045306 | A1 | 11/2001 | Fielder et al. | |
| 2002/0020526 | A1 | 2/2002 | Male et al. | |
| 2002/0056574 | A1 | 5/2002 | Harvey | |
| 2002/0125047 | A1 | 9/2002 | Beaton | |
| 2002/0166703 | A1 | 11/2002 | Presley | |
| 2003/0173114 | A1 | 9/2003 | Presley | |
| 2003/0221873 | A1 | 12/2003 | Beaton | |
| 2004/0099448 | A1 | 5/2004 | Fielder | |
| 2004/0206552 | A1 | 10/2004 | Beaton | |
| 2006/0207801 | A1 | 9/2006 | Clayton | |
| 2007/0163810 | A1 | 7/2007 | Underwood et al. | |
| 2010/0018779 | A1 | 1/2010 | Makkar | |
| 2010/0078216 | A1 | 4/2010 | Radford | |
| 2010/0089659 | A1 | 4/2010 | Chafai | |
| 2010/0116556 | A1 | 5/2010 | Buske | |
| 2011/0127044 | A1 | 6/2011 | Radford | |
| 2011/0220416 | A1 | 9/2011 | Rives | |
| 2012/0057814 | A1 | 3/2012 | Dodson | |
| 2012/0255786 | A1 | 10/2012 | Isenhour | |
| 2012/0279784 | A1 | 11/2012 | Harvey | |
| 2013/0180779 | A1 | 7/2013 | Isenhour | |
| 2013/0233620 | A1 | 9/2013 | Rankin | |
| 2014/0064646 | A1 | 3/2014 | Meier | |
| 2014/0131111 | A1 | 5/2014 | Desmette | |
| 2015/0129309 | A1 * | 5/2015 | Anderson | E21B 17/1078 175/57 |
| 2017/0241207 | A1 | 8/2017 | Meier | |
| 2019/0226285 | A1 * | 7/2019 | Teodorescu | E21B 10/26 |

FOREIGN PATENT DOCUMENTS

| | | |
|---|---|---|
| WO | 2008026011 | 3/2008 |
| WO | 2009123918 | 10/2009 |

OTHER PUBLICATIONS

International Search Report and Written Opinion dated Dec. 20, 2018 for corresponding PCT/US2018/055230.

International Patentability Report for PCT/US13/050205 dated Dec. 23, 2013.

International Patentability Report for PCT/US12/58573 dated Jan. 22, 2013.

Schlumberger Oilfield Glossary entry for "borehole", accessed Aug. 12, 2013 via www.glossary.oilfield.slb.com.

Schlumberger Oilfield Glossary entry for "Ream" and "Underreamer", accessed May 22, 2013 via www.glossary.oilfield.slb.com.

PCT/US2012/032714; Search Report in International Patent Application of Isenhour, James; Jun. 20, 2012.

Plaintiff's Complaint; *James D. Isenhour, Hard Rock Solutions Inc* vs *Lot William Short, Jr., Short Bit & Tool Co.*, Civil Action No. 11CV1305, Colorado District Court, Larimer County; Oct. 4, 2011.

Plaintiff's First Amended Complaint; *James D. Isenhour, Hard Rock Solutions Inc.* vs *Lot William Short, Jr., Short Bit & Tool Co.*, Civil Action No. 11CV1305, Colorado District Court, Larimer County; Oct. 4, 2011.

Plaintiff's Second Amended Complaint; *James D. Isenhour, Hard Rock Solutions Inc.* vs *Lot William Short, Jr., Short Bit & Tool Co.*, Civil Action No. 11CV1305, Colorado District Court, Larimer County; Jun. 1, 2012.

Defendant's Answer to Plaintiff' Second Amended Complaint & Counterclaims; *James D. Isenhour, Hard Rock Solutions Inc.* vs *Lot William Short, Jr., Short Bit & Tool Co.*, Civil Action No. 11CV1305, Colorado District Court, Larimer County; Jun. 15, 2012.

Plaintiff's Reply to Counterclaim and Answer to Cross Claim; *James D. Isenhour, Hard Rock Solutions Inc.* vs *Lot William Short, Jr., Short Bit & Tool Co.*, Civil Action No. 11CV1305, Colorado District Court, Larimer County; Jun. 25, 2012.

Defendant's Initial Disclosures; *James D. Isenhour, Hard Rock Solutions Inc.* vs *Lot William Short, Jr., Short Bit & Tool Co.*, Civil Action No. 11CV1305, Colorado District Court, Larimer County; Jun. 30, 2012.

Plaintiff's Disclosure Statement; *James D. Isenhour, Hard Rock Solutions Inc.* vs *Lot William Short, Jr., Short Bit & Tool Co.*, Civil Action No. 11CV1305, Colorado District Court, Larimer County; Aug. 2, 2012.

Short Bit & Tool Co.; Photograph of TCS Reamer; Apr. 2011.

Short Bit & Tool Co.; Photograph of BCS Tandem and TCS Reamer; Feb. 11, 2011.

Baker Hughes; "RWD2 Ream-While-Drilling"; http://www.bakerhughes.com/products-and-services/drilling/d rill-bit-systems/hole-enlargemenUrwd2-ream-while-drilling; 2012.

OTS International; "TPXR Eccentric Reamers"; http://www.otsintl.corn/tpxr.asp; 2012.

OTS International; "TPXR Eccentric Tool for Underreaming Operations"; http://www.otsintl.com/TPXR.pdf; 2012.

Schlumberger; "Diamond-Enhanced Insert Reamer"; http://www.slb.com/services/drilling/tools_services/reamers_stabilizers/diamond_enhanced_reamer.a spx;2012.

National Oilwell Varco; "Eccentric String Tools (ES)"; http://www.nov.com/Brands/ReedHvcaloq/Eccentric Strinq Tools.aspx; 2012.

Stabil Drill; "Ghost Reamer"; http://www.stabildrill.com/products/ghost_reamer/; 2011.

Schlumberger; "Quad-D Reamer"; http://www.slb.com/services/drilling/tools services/underreamers/quad d reamer.aspx; 2012.

OTS International; "TP Bits"; http://www.otsintl.com/tp.asp; 2012.

OTS International; "TP Series Hyper-Stable PDC Bits"; http://www.otsintl.com/TP-Series-Bits.pdf; 2012.

National Oilwell Varco; "NOV Downhole—Right Tool, Right Place, Right Time" catalog; http://www.petroleumclub.ro/downloads/07 Tony Watts NOV ReedHycalog.pdf; 2012.

(56) References Cited

OTHER PUBLICATIONS

Offshore; "Drilling Operations, Reaming-while-drilling keys effort to reduce tripping of long drillstrings"; http://www.offshore-mag.com/articles/prinUvolume-56/issue-4/departments/drilling-production/drilling-operations-reaming-while-drilling-keys-effort-to-reduce-tripping-of-long-drillstrings.html; 2012.
Varel International; "Hole Opening Bits—Bicenter Technology"; http://www.varelintl.com/Oil and Gas Home/PDC Drill Bits/Hole Opener Bicenter Bits/; 2012.
Omni Oil Technologies; "Group II—OMNI Versaltile Drilling Reamer/Stabilizer"; http://www.omnioiltech.com/qroup2.php; 2012.
Tercel Oilfield Products; "Versatile Drilling Reamer (VDR)"; http://www.terceloilfield.com/en/drilling-enhancement-vd r. php; 2012.
Sep. 3, 2019 Office Action issued in CN 201810945033.1.
Dictionary definition of "similar", accessed May 22, 2013 via thefreedictionary.com.
Schlumberger Oilfield Glossary entry for "measurements while drilling" accessed Mar. 25, 2019 via www.glossary.oilfield.slb.com.
Third Party Submission of References filed in unrelated U.S. Appl. No. 16/256,690. The submission provides a concise description of the noted references relative to U.S. Appl. No. 16/256,690, filed Jan. 24, 2020.
Uyen Partin et al., IADC/SPE 128161—Advanced Modeling Technology: Optimizing Bit-Reamer Interaction Leads to Performance Step-Change in Hole Enlargement While Drilling (IADC/SPE Drilling Conference held New Orleans, LA, Feb. 2-4, 2010)(also available at onepetro.org).
Hal Edwards et al., SPE 158920—Modeling System Improves Salt Drilling Technique with Concentric Reamer/RSS, Deepwater GOM (SPE Annual Technical Conference and Exhibition held San Antonio, TX Oct. 8-10, 2012) (also available at onepetro.org).

* cited by examiner

WELL BORE CONDITIONER AND STABILIZER

REFERENCE TO RELATED APPLICATIONS

This application claims priority to U.S. Provisional Application Nos. 62/556,379, filed Sep. 9, 2017, and 62/649,666, filed Mar. 29, 2018, both entitled "Well Bore Conditioner and Stabilizer," and both hereby specifically and entirely incorporated by reference.

BACKGROUND

1. Field of the Invention

This invention is directed to well bore conditioning and stabilizing devices and systems. Specifically, the invention is directed to well bore conditioning and stabilizing devices and systems that maximize both well bore contact and flow area.

2. Description of the Background

Stabilizers are common within the well bore drilling industry. A drilling stabilizer is a piece of downhole equipment used in the bottom hole assembly (BHA) of a drill string. Roller stabilizers are typically placed in the drill string a short distance above the motor. Stabilizers mechanically stabilize the BHA in the borehole in order to avoid unintentional sidetracking, reduce or eliminate vibrations that originate at the drill bit from traveling up the rest of the drill string, and ensure the quality of the hole being drilled. As shown in FIG. 8, existing roller stabilizers typically have structures, for example a number of small rollers 880 in a concentric array, that reach out toward the well bore and are intended to make close contact with the bore. Typically, drill strings have an outer diameter of 9.25" for a 12.25" diameter hole. As can be seen in FIG. 8, existing rollers have a diameter smaller than the diameter of the drill string. For example, existing rollers may have an inner diameter of 20%, 25% or 30% of the diameter of the drill string. The stabilizers are intended to transmit unwanted drill string vibrations through the tool to the well bore, damping them out from the system and sometimes they smooth the bore by pulverizing rough spots. However, in current designs, the rollers typically do not reach all the way to the walls so the stabilizer can fit in the hole.

A desirable feature in a stabilizer is 360-degree contact between the tool and the bore walls. However, a competing desirable feature is for the tool to allow plenty of flow area through the stabilizing features. Therefore, in designing stabilizers, one must balance the percentage of contact between the tool and the bore walls with the amount of flow the tool allows. Furthermore, it is desirable to have a tool that can fit through the well bore yet maximizes contact with the well bore.

SUMMARY

The present invention overcomes the problems and disadvantages associated with current strategies and designs and provides new tools and systems for conditioning and stabilizing drill strings during drilling well bores.

One embodiment of the invention is directed to a drill string stabilizer. The drill string stabilizer comprises a tubular body and at least two stabilizing elements protruding from the exterior of the tubular body. The at least two stabilizing elements are angularly offset from each other around the circumference of the tubular body.

Preferably, each stabilizing element further comprises at least one well bore contacting surface. In a preferred embodiment, each well bore contacting surface is a polycrystalline diamond compact (PDC) surface. Preferably, the stabilizing elements are separated by a plenum.

Preferably, the at least two stabilizing elements together provide 360° contact with a well bore and each stabilizing element provides an open line-of-sight path through the stabilizing elements. The drill string stabilizer preferably further comprises protrusions extending from each of the at least two stabilizing elements. Preferably, the at least two stabilizing elements are angularly offset from each other such that the protrusions of one stabilizing element is not in line with the protrusions of another stabilizing element. In a preferred embodiment, a pass-through diameter of the stabilizer is smaller than a gauge diameter of the stabilizer.

Preferably, the at least two stabilizing elements are eccentrically positioned on the tubular body. Preferably, there are two stabilizing elements and the two stabilizing elements are diametrically opposed to each other around the tubular body. In a preferred embodiment, each stabilizing element is comprised of a race with a roller within the race. Preferably, the rollers are able to freely rotate within the races. The drill string stabilizer preferably further comprises a bearing positioned between the race and the roller. Preferably, each stabilizing element is comprised of a stationary wear pad.

Another embodiment of the invention is directed to a bottom hole assembly (BHA). The BHA comprises a well bore drill and drill string stabilizer. The drill string stabilizer comprises a tubular body and at least two stabilizing elements protruding from the exterior of the tubular body. The at least two stabilizing elements are angularly offset from each other around the circumference of the tubular body and the drill string stabilizer is adapted to condition the well bore and reduce vibrations caused by the well bore drill.

In a preferred embodiment, each stabilizing element further comprises at least one well bore contacting surface. Preferably, each well bore contacting surface is a polycrystalline diamond compact (PDC) surface. The stabilizing elements are preferably separated by a plenum.

Preferably, the at least two stabilizing elements together provide 360° contact with a well bore and each stabilizing element provides an open line-of-sight path through the stabilizing elements. Preferably further comprising protrusions extending from each of the at least two stabilizing elements. In a preferred embodiment, the at least two stabilizing elements are angularly offset from each other such that the protrusions of one stabilizing element is not in line with the protrusions of another stabilizing element. Preferably, a pass-through diameter of the stabilizer is smaller than a gauge diameter of the stabilizer.

In a preferred embodiment, the at least two stabilizing elements are eccentrically positioned on the tubular body. There are preferably two stabilizing elements and the two stabilizing elements are diametrically opposed to each other around the tubular body. Preferably, each stabilizing element is comprised of a race with a roller within the race. Preferably, the rollers are able to freely rotate within the races. In a preferred embodiment, the at least two stabilizing elements further comprise a bearing positioned between the race and the roller. Preferably, each stabilizing element is comprised of a stationary wear pad.

Other embodiments and advantages of the invention are set forth in part in the description, which follows, and in part, may be obvious from this description, or may be learned from the practice of the invention.

DESCRIPTION OF THE INVENTION

One way to maximize both contact area and flow area of the stabilizer is to spiral the stabilizing structures. However, the suitability of the flow area is often judged by end users by looking for an open line-of-sight path through the features. A spiral that is too long or twists too tightly (which would not provide an open line-of-sight path) is believed to encourage the buildup of cuttings and will result in blockage of the flow area.

Figure 1:
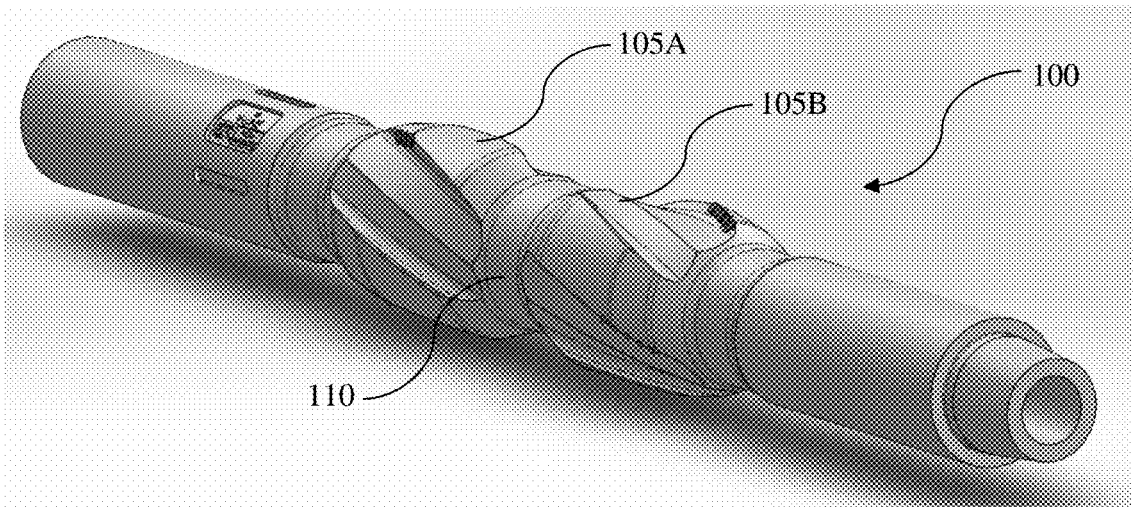
FIG. 1 Depicts a first embodiment of a conditioning and stabilizing device with two stages.
Figure 2:
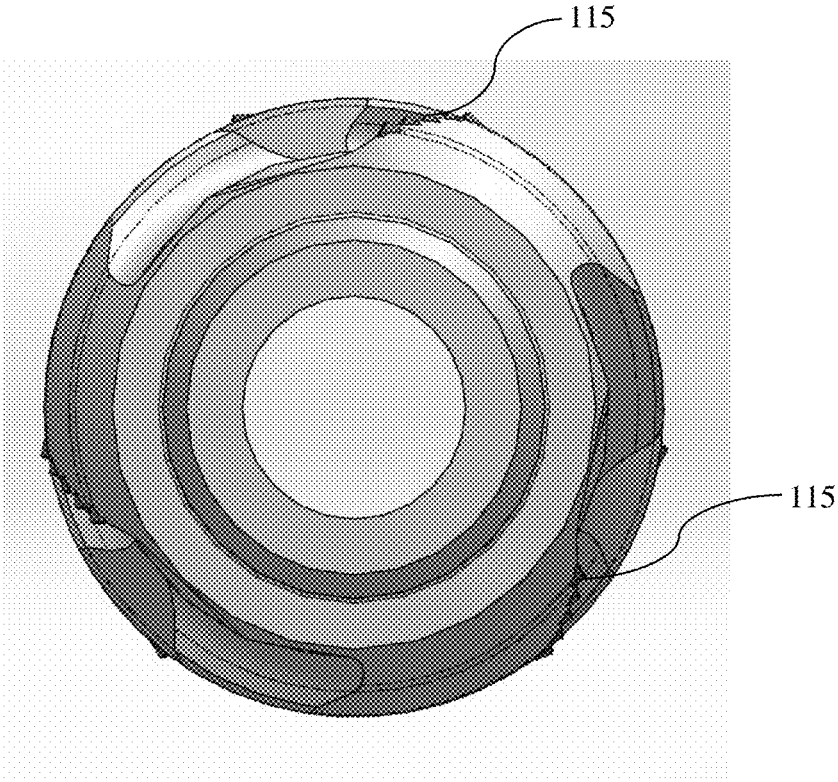
FIG. 2 Depicts the first embodiment of the device shown in FIG. 1 viewed down the drill string.
Figure 3:
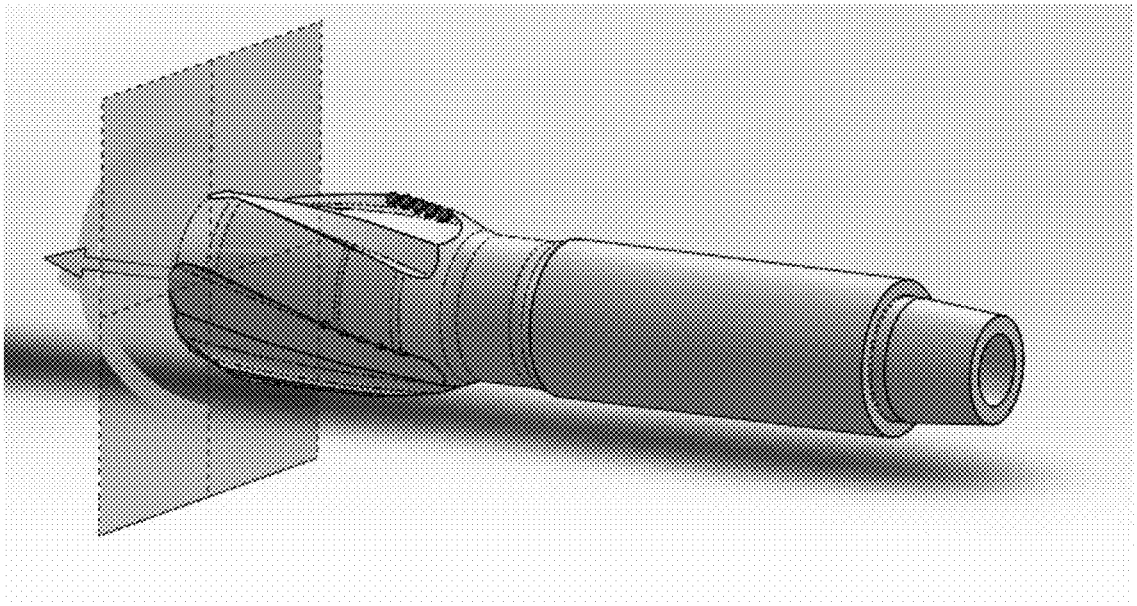
FIG. 3 Depicts a single stage of the first embodiment of the device shown in FIG. 1.
Figure 4:
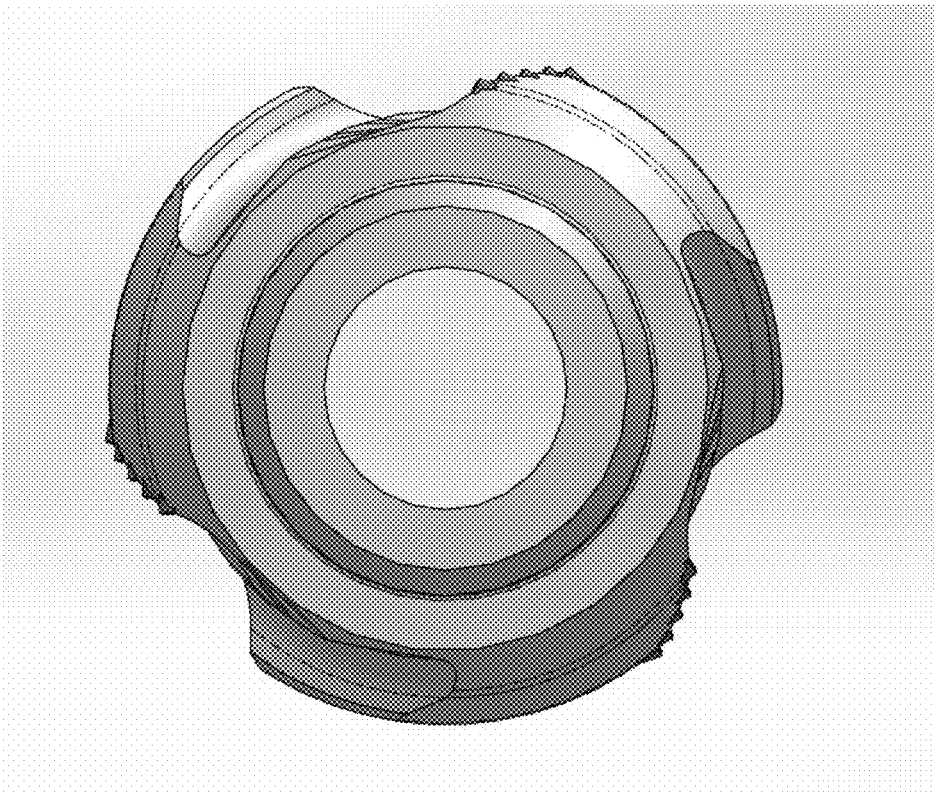
FIG. 4 Depicts a single stage of the first embodiment of the device shown in FIG. 1 viewed down the drill string.
Figure 5:
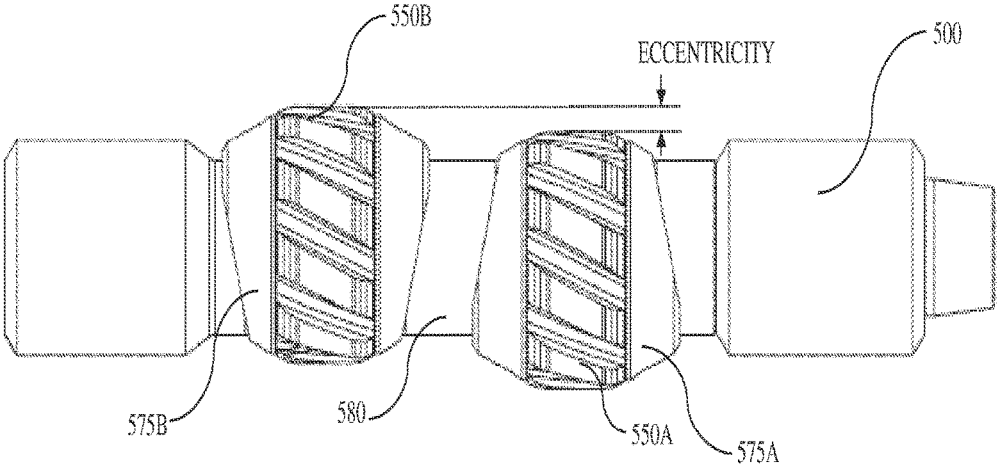
FIG. 5 Depicts a second embodiment of a stabilizing device with two eccentric stabilizers.

As shown in FIG. 1, to satisfy both 360° contact and line-of-sight flow path requirements stabilizer 100 utilizes two stabilizer sections or lobes 105A and 105B divided by a plenum 110 that interrupts the stabilizing features. The features on the back lobe 105A are angularly offset from the front lobe 105B, and in this way 360° contact is still achieved. For example, as can be seen in FIG. 2, looking down the drill string, the front lobe 105A and back lobe 105B combine to have 360° contact. Additionally, plenum 110 effectively interrupts the flow restrictions caused by lobes 105A and 105B, so the stabilizer 100 operates with lobes 105A and 105B that both satisfy the line-of-sight requirement, as shown in FIG. 4. Thus, while together lobes 105A and 105B do not satisfy the line-of-sight requirement (as shown in FIG. 2), lobes 105A and 105B individually satisfy the line-of-sight requirement (as shown in FIG. 4) and, in combination with plenum 110, achieve the desired flow of cuttings and prevent blockage of the flow area without limiting the contact of stabilizer 100 with the well bore.

Preferably lobes 105A and 105B are identical. However, lobes 105A and 105B may be similar or different. Lobes 105A and 105B preferably have 2, 3, 4, 5, 6, or more spiraled protrusions. The protrusions on each lobe may spiral in the same direction or opposite directions. Preferably, the protrusions are equally spaced about the drill string. However, the protrusions may be eccentric or have another distribution. Between each protrusion is preferably a gap to allow the flow of drilling fluid and cuttings. At least a portion of the protrusions have cutters 115 extending from them. Cutters 115 clean up roughness in the well bore as the tool moves by, and also ensure the bore will have the proper fit against the stabilizing features. Preferably, cutters 115 cover at least a portion of each protrusion. However, cutters 115 may cover all of each protrusion. Preferably, cutters 115 are positioned so that the cutting face is tangential to the drill string. Cutters 115 are preferably polycrystalline diamond compact (PDC) surfaces. However, the cutters may be another material.

Figure 6:
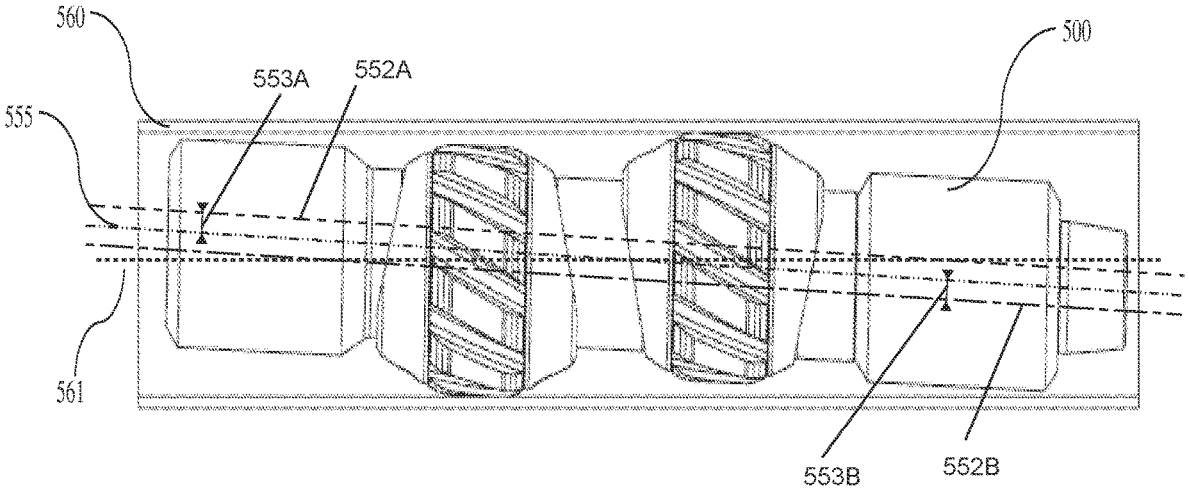
FIG. 6 Depicts a side view the second embodiment within the well bore.

A second embodiment of the invention is directed to a stabilizer 500 with two eccentric rollers 550A and 550B. To keep rollers 550A and 550B in contact with the well bore 560, as shown in FIG. 6, while not getting stuck within the well bore 560, rollers 550A and 550B are offset axially so stabilizer 500 can fit through tight spots by twisting/flexing out of axial alignment with the well bore 560. For example, as shown in FIG. 6, the axis 555 of stabilizer 500 may be at an angle to the axis 561 of well bore 560 while stabilizer 500 is in use.

Figure 7A:
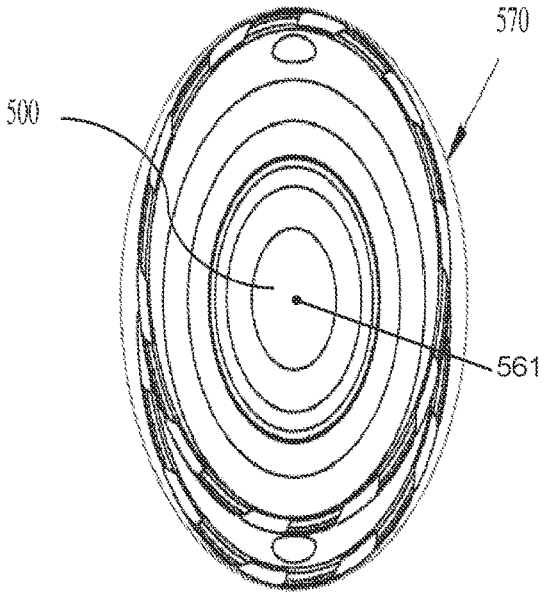
FIGS. 7A-B Depict front views of the second embodiment within the well bore.
Figure 7B:
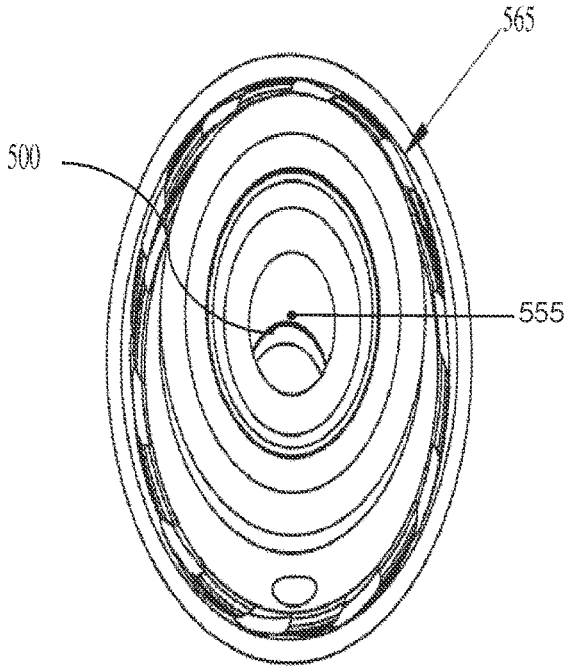

Furthermore, as can be seen in FIGS. 7A and 7B, the pass-through diameter 565 of stabilizer 500, which can be seen looking directly down the axis 555 of stabilizer 500, is smaller than the gauge diameter 570 of stabilizer 500, which can be seen looking directly down the axis 561 of well bore 560. Thus, stabilizer 500 can fit through a well bore 560 that is narrower than the gauge diameter of stabilizer 500.

Figure 8:
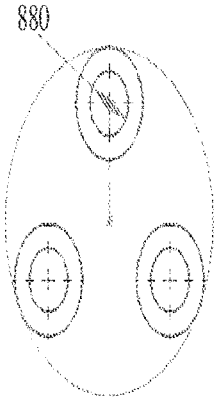
FIGURE 8 Prior Art
FIG. 8 Depicts a cutaway end view of a prior art stabilizer.

Preferably, each roller or stabilizing element 550A and 550B is eccentrically positioned such that the axis, 552A and 552B, of the roller 550A, 550B, respectively, is offset a first fixed distance 553A and a second fixed distance 553B, respectively, from the axis of stabilizer 500. Preferably the eccentricity of each roller is diametrically opposed about stabilizer 500 from the other roller. However, in other embodiments, the eccentricity of each roller may be at a different angle from the other roller. For example, the rollers may be 90°, 45°, 135°, or another angle apart. While two rollers a shown, in some embodiment, more than 2 rollers are employed at various positions. In embodiments where large rollers are not possible, two or more small eccentric rollers may be employed. In other embodiments where rollers are not possible, two or more eccentric wear pads may be used instead. Rollers 550A and 550B and the associated bearings are preferably large compared to traditional roller stabilizers (see FIG. 8). For example, the rollers of the instant application maybe have an outer diameter of 10", 11", 11.125", 12", or 13" and the bearing surface of the rollers may have an inner diameter of 8", 9", 9.15", 10" or 11". Preferably, the outer diameter of rollers 550A and 550B is 100%, 110%, 120%, 130%, or 140% of the drill string diameter, and the inner diameter (bearing surface) of rollers 550A and 550B is 90%, 95%, 99%, 105%, or 110% of the drill string diameter. With the larger size of the rollers and bearings compared to existing rollers and bearings, the bearings preferably have greater longevity, extending the intervals between repairs compared to traditional roller stabilizers' repair intervals.

It is contemplated that aspects of any embodiment described herein can be employed in any other embodiment described herein. Furthermore, embodiments can be combined in any orientation. Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. The term comprising, where ever used, is intended to include the terms consisting and consisting essentially of. Furthermore, the terms comprising, including, and containing are not intended to be limiting. It is intended that the specification and examples be considered exemplary only with the true scope and spirit of the invention indicated by the following claims.

The invention claimed is:

1. A drill string stabilizer for use in a well bore, the well bore having a well bore axis and a well bore wall, comprising:

a tubular body with a stabilizer axis;

a first roller including a first roller axis spaced a first fixed distance apart from the stabilizer axis of the tubular body; and, at least a second roller spaced longitudinally apart from the first roller, the at least the second roller including a second roller axis spaced a second fixed distance apart from the stabilizer axis of the tubular body;

wherein the first roller is angularly offset from the at least the second roller around a circumference of the tubular body; and, a plenum that separates the first roller and the at least the second roller, wherein a pass-through diameter of the drill string stabilizer is smaller than a gauge diameter of the drill string stabilizer.

2. The drill string stabilizer of claim 1, wherein the first roller and the at least the second roller further comprises at least one well bore contacting surface.

3. The drill string stabilizer of claim 2, wherein the at least one well bore contacting surface is a polycrystalline diamond compact (PDC) surface.

4. The drill string stabilizer of claim 1, wherein the first roller and the at least the second roller provide an open line-of-sight path through the first roller and the at least the second roller.

5. The drill string stabilizer of claim 1, wherein the first roller and the at least the second roller further comprise at least two protrusions extending from each of the first roller and the at least the second roller.

6. The drill string stabilizer of claim 5, wherein the at least two protrusions of the first roller are not in line with the protrusions of the at least the second roller.

7. The drill string stabilizer of claim 1, wherein the first roller is diametrically opposed to the at least the second roller.

8. The drill string stabilizer of claim 1, wherein the first roller includes a race and the at least a second roller includes another race.

9. The drill string stabilizer of claim 8, wherein the first roller and the at least a second roller are able to freely rotate within the race and the another race, respectively.

10. The drill string stabilizer of claim 8, further comprising a bearing positioned between the race and the first roller.

11. A bottom hole assembly (BHA) for use in a well bore, the well bore having a well bore axis and a well bore wall, comprising:

a well bore drill; and, at least the drill string stabilizer of claim 1.

12. A drill string stabilizer for use in a well bore, the well bore having a well bore axis and a well bore wall, comprising:

a tubular body with a stabilizer axis;

a first stabilizing element including a first stabilizing element axis offset a first fixed distance from the stabilizer axis; and, at least the second stabilizing element spaced apart from the first stabilizing element, the at least a second stabilizing element including a second stabilizing element axis offset a second fixed distance from the stabilizer axis;

wherein the first stabilizing element is angularly offset from the at least the second stabilizing element around a circumference of the tubular body; and, a plenum that separates the first stabilizing element and the at least the second stabilizing element, wherein a pass-through diameter of the drill string stabilizer is smaller than a gauge diameter of the drill string stabilizer.

13. The drill string stabilizer of claim 12, wherein the first stabilizing element and the at least the second stabilizing element comprise a stationary wear pad.

14. The drill string stabilizer of claim 12, wherein the first stabilizing element comprises a first roller and wherein the at least the second stabilizing element comprises at least a second roller.

15. The drill string stabilizer of claim 12, wherein the first stabilizing element is diametrically opposed to the at least the second stabilizing element.

* * * * *